US006994326B1

(12) United States Patent
Tyson

(10) Patent No.: US 6,994,326 B1
(45) Date of Patent: Feb. 7, 2006

(54) FENCE WITH PLUGGED OPENINGS AND METHODS OF PLUGGING SAME

(75) Inventor: James M. Tyson, Harrisburg, PA (US)

(73) Assignee: Tyson Fence Co., Inc., Harrisburg, PA (US)

( * ) Notice: Subject to any disclaimer, the term of this patent is extended or adjusted under 35 U.S.C. 154(b) by 14 days.

(21) Appl. No.: 10/759,825

(22) Filed: Jan. 20, 2004

(51) Int. Cl.
*E04H 17/00* (2006.01)

(52) U.S. Cl. ..... 256/1; 256/65.02; 256/59; 256/22; 138/89; 220/801

(58) Field of Classification Search ..... 256/1, 256/19, 59, 65.01, 65.16, 66, 65.02, 22; 138/89; 411/510; 52/300; 215/355; 220/801, 802, 220/804
See application file for complete search history.

(56) References Cited

U.S. PATENT DOCUMENTS

| | | | | |
|---|---|---|---|---|
| 2,737,205 A | | 3/1956 | Stringfield | 138/89 |
| 3,037,745 A | | 6/1962 | Zeman | 256/54 |
| 3,272,059 A | * | 9/1966 | Lyday et al. | 411/510 |
| 3,494,244 A | * | 2/1970 | Wayland | 411/510 |
| 3,578,027 A | | 5/1971 | Zopfi | 138/89 |
| 3,869,109 A | * | 3/1975 | Russo | 256/59 |
| 3,955,800 A | * | 5/1976 | Russo | 256/59 |
| 4,454,699 A | * | 6/1984 | Strobl | 411/510 |
| 4,615,154 A | | 10/1986 | Troutner | 52/40 |
| 5,195,859 A | * | 3/1993 | Thornton, Jr. | 411/510 |
| 5,287,892 A | * | 2/1994 | Sanderson et al. | 138/89 |
| 5,308,205 A | * | 5/1994 | Lautenschlager | 411/510 |
| 5,327,942 A | | 7/1994 | Black | 138/89 |
| 6,032,694 A | | 3/2000 | Wellen et al. | 138/89 |
| 6,032,695 A | | 3/2000 | Wellen et al. | 138/89 |
| 6,347,488 B1 | | 2/2002 | Koye | 52/40 |
| 6,360,779 B1 | * | 3/2002 | Wagner et al. | 138/89 |
| D458,350 S | | 6/2002 | Wagner et al. | D23/260 |
| 6,494,463 B1 | * | 12/2002 | Rank | 138/89 |
| 6,520,704 B1 | * | 2/2003 | Vidmar et al. | 403/188 |
| 6,755,394 B2 | * | 6/2004 | Forbis et al. | 256/65.01 |

FOREIGN PATENT DOCUMENTS

GB 1551855 A * 9/1979

* cited by examiner

*Primary Examiner*—Daniel P. Stodola
*Assistant Examiner*—Ernesto Garcia
(74) *Attorney, Agent, or Firm*—Charles M. Kaplan

(57) ABSTRACT

A fence with hollow posts and rails uses a flexible plug that is placed in insect entry path blocking position by sliding the plug into a fence rail in a direction that is perpendicular to the longitudinal axis of the plug. A friction fit between shoulders on the plug and a rib and ledge inside of the rail is attained by the relative spacing of the shoulders to the spacing of the rib and ledge.

9 Claims, 4 Drawing Sheets

FENCE WITH PLUGGED OPENINGS AND METHODS OF PLUGGING SAME

BACKGROUND OF THE INVENTION

This invention relates to preventing flying insects, such as bees, wasps, hornets and the like, from entering and nesting in hollow fence components. In particular, this invention involves the blocking of a path that could be used by flying insects to enter a hollow fence post.

OBJECTIVES OF THE INVENTION

Accordingly, it is an object of this invention to provide improved apparatus and methods for preventing insects from nesting in hollow structures.

Another object is to provide a resilient plug that will fit into an open sided fence component in a way that prevents insects from passing through an opening in another fence component.

An additional object is to provide a plug that is placed into space-blocking relationship within a fence part by sliding the plug in a direction that is perpendicular to the longitudinal central axis of the plug.

Another object is to provide improved hollow fences in which flying insects are discouraged from building nests.

Another object is to provide a plug with flexible, flat, noncircular, non tapered shoulders that hold the plug in place.

A further object is to provide methods of non axially sliding plugs into insect path blocking positions in hollow structures.

An additional object is to provide plugs that are reusable after some of the flexible shoulders on the plug have been bent out of shape.

A further object is to provide fences with insect stopping plugs and structural components that are durable, economical, easy to use and maintain and replace, and which do not possess defects found in similar prior art fences and insect deterring products.

Other objects and advantages of the plugs, fences and methods incorporating this invention will be found in the specification and claims and the scope of the invention will be set forth in the claims.

DESCRIPTION OF THE INVENTION

Figure 1:
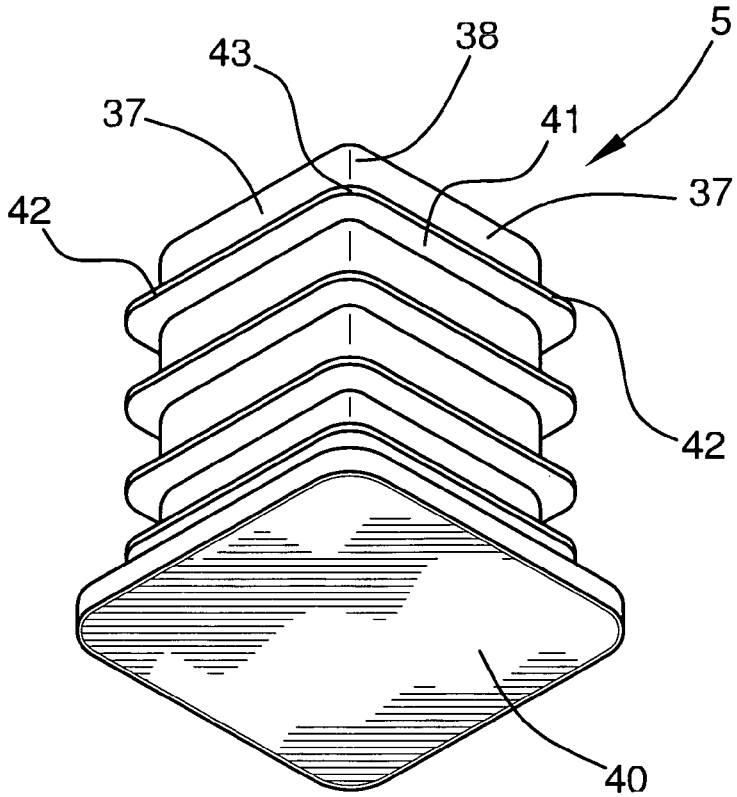
FIG. 1 is a perspective view of an embodiment of a plug in accord with this invention.

The drawing shows an integral, resilient, hollow plug 5 for substantially filling and blocking openings in a hollow rectangular rail 6 and an interconnected hollow rectangular post 7 of a fence 8 that has spaced hollow rectangular pickets 9. The post 7 has a flat side 10, and a rectangular holes 11 in side 10 for insertion of rails 6. The hole 11 is sufficiently large to permit flying insects such as bees, wasps and the like to enter and nest in the post.

Rectangular rail 6 has an open terminal ends 14. Rail 6 has three continuous elongated flat sides that have the same length. One side 15 is horizontal, the remaining two sides 16 and 17 being vertical and parallel to each other. Rail 6 has another side 18 that defines a channel opening running for its entire length. The sides 16 and 17 are joined to each other at right angles at their corners 19 so that the rail has the configuration of a three sided square with one open side that faces downwardly. Sides 16 and 17 have bottom locator notches 20 and 21 that reduce the size of the rail at open end 14. Each of the flat sides 15–17 has an inside surface 22 that is exposed to the atmosphere through open side 18. Vertical sides 16 and 17 have longitudinally extending ledges 23 and 24 at their lower end that project from their inside surfaces 22 toward each other into open side 18. Each ledge has an upper surface 25. Side 17 has a pair of parallel longitudinally extending ribs 26 and 27 on its inside surface 22 that project perpendicularly from surface 22 toward side 16. Ribs 26 and 27 have have lower surfaces 28 and 29, respectively. The upper surface 25 of ledge 23 and the lower surfaces 28 and 29 of the ribs are parallel.

Figure 3:
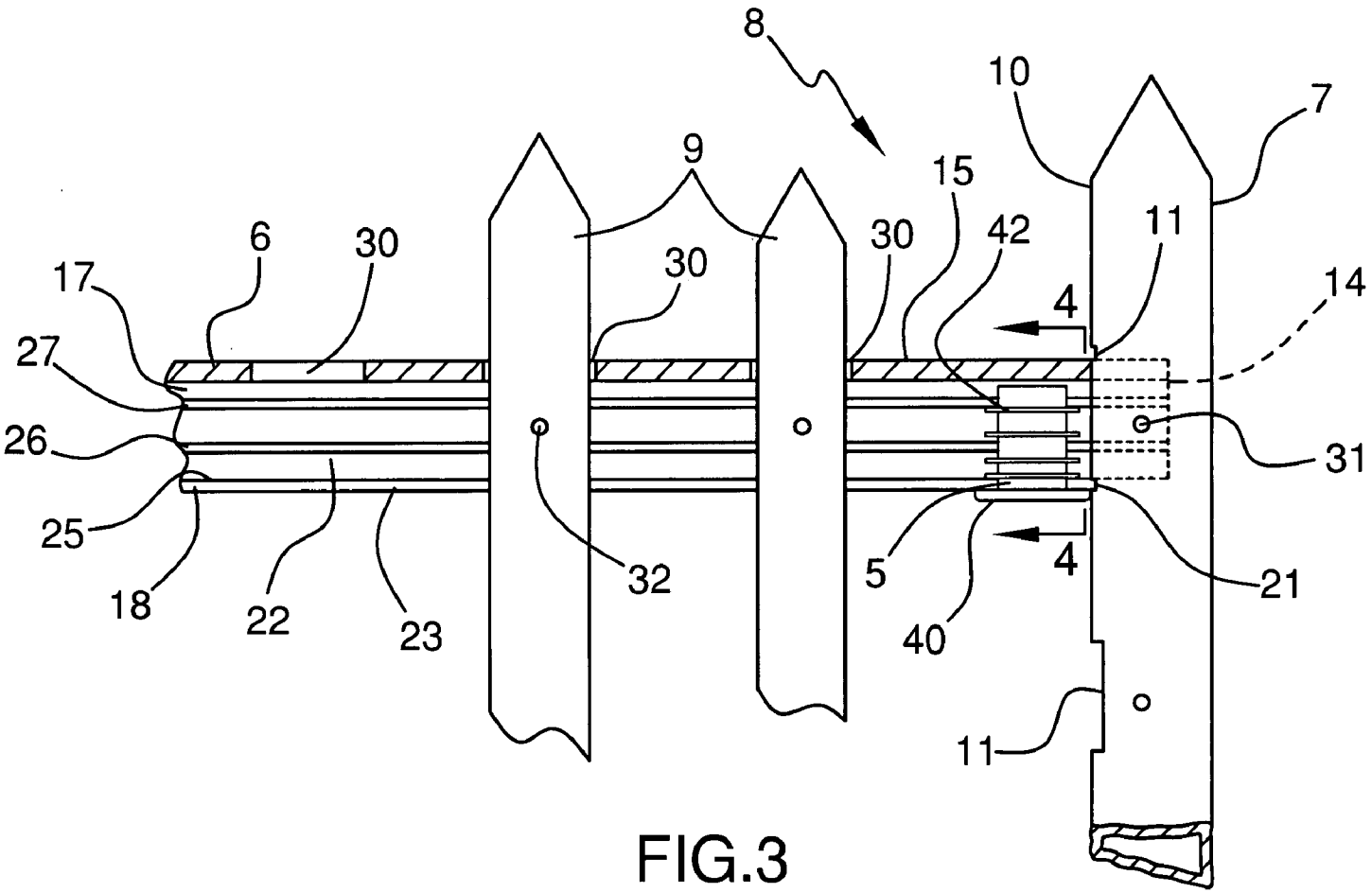
FIG. 3 is schematic, partially broken away, partially cross sectional fragmentary elevational view of a fence in accord with this invention.
Figure 4:
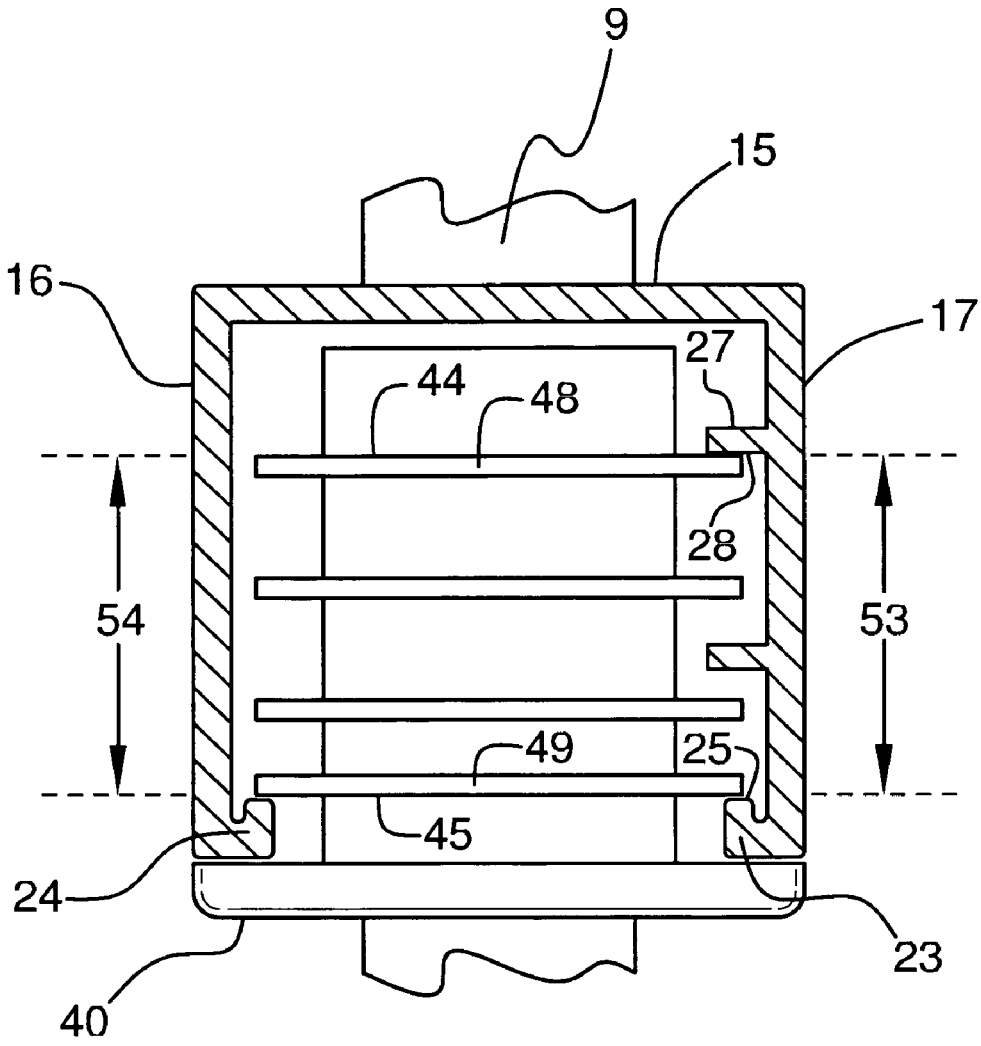
FIG. 4 is an enlarged cross sectional view taken along the line 4—4 in FIG. 3.

The hole 11 is just slightly larger than the reduced size of rail 6 at the notched open end 14. As shown in FIG. 3, a rail 6 has been inserted into a hole 11 in post 7 until the notches 20 and 21 touch the side 10, with the open side 18 of the rail facing downwardly. A threaded fastener 31 secures rail 6 in post 7. The pickets 9 extend upwardly through the open side 18 of rail 6 and through spaced holes 30 in rail 6, where the pickets are secured in place by threaded fasteners 32. The use of the notches 20 and 21 as stops that position the holes 30 of each rail 6 the same distance from the side 10 ensures that corresponding holes 30 in other rails that have been inserted into other holes 11 will all be aligned vertically. The result is that the pickets 9 will be parallel to each other and to the post 7. The open side 18 of rail 6 and the open terminal end 14 of the rail provide a continuous atmospheric path that would enable flying insects to enter and nest in post 5 through the hole 11, if that path were not blocked. Only one rail 6 has been shown to simplify the drawing.

This invention uses the plug 5 to block the insect invasion path through the rail and post. The plug 5 should be made from a durable, weather resistant, flexible rubber or plastic material, such as neoprene, polyethylene, polypropylene, PVC or the like. Plug 5 has a main body portion 35 that has a central longitudinal axis 36 and four identical sides 37 having the same length, width and thickness. The sides 37 are joined to each other at right angles at their corners 38 so that the body 35 is a hollow cube with one end 39 open to the atmosphere and the other end closed by an end cap 40.

Figure 2:
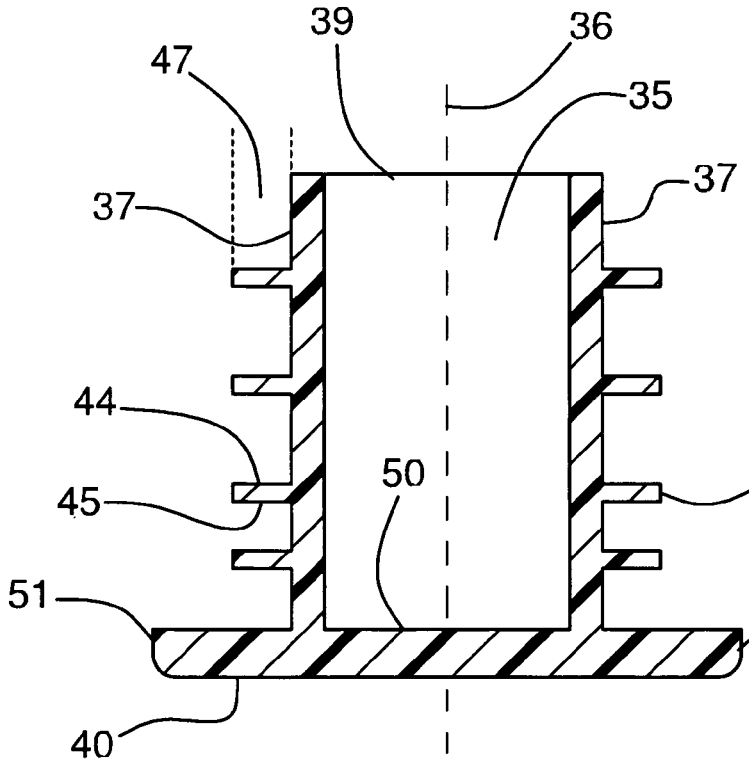
FIG. 2 is a cross sectional view of the plug shown in FIG. 1.

Four identical shoulders 41 of uniform thickness protrude from and surround body 35. The shoulders 41 are spaced from each other at equal predetermined distances along the axis 11. Each of the shoulders has a segment 42 that is integral with one of the four sides of the body 35. The segments 42 are joined to each other at a right angle at each of their ends 43 so that each shoulder continuously circumscribes the body 35. Each of the segments 42 has a continuous upper flat surface 44 and a continuous lower flat surface 45. As shown in FIG. 2, all of the upper and lower flat surfaces 44 and 45 extend perpendicularly from the sides 37 of body 35 in parallel planes that are perpendicular to the longitudinal axis 36. The upper and lower flat surfaces 44 and 45 of each segment 42 have flat outer edges 46 that terminate at the same distance 47 from the sides 37 of body 35. When the plug 5 is used to block the insect path, the shoulder 48 is the uppermost shoulder and the shoulder 49 is the lowermost.

As shown in FIG. 2, end cap 40 has a flat inner surface 50 that is integral with body 35, and this inner surface is parallel to the parallel planes of flat surfaces 44 and 45 of segments 42. End cap 40 has outer peripheral edges 51 that extend past body 35 beyond the distance 47 that the outer edges 46 terminate past the sides 37 of body 35.

Figure 5:
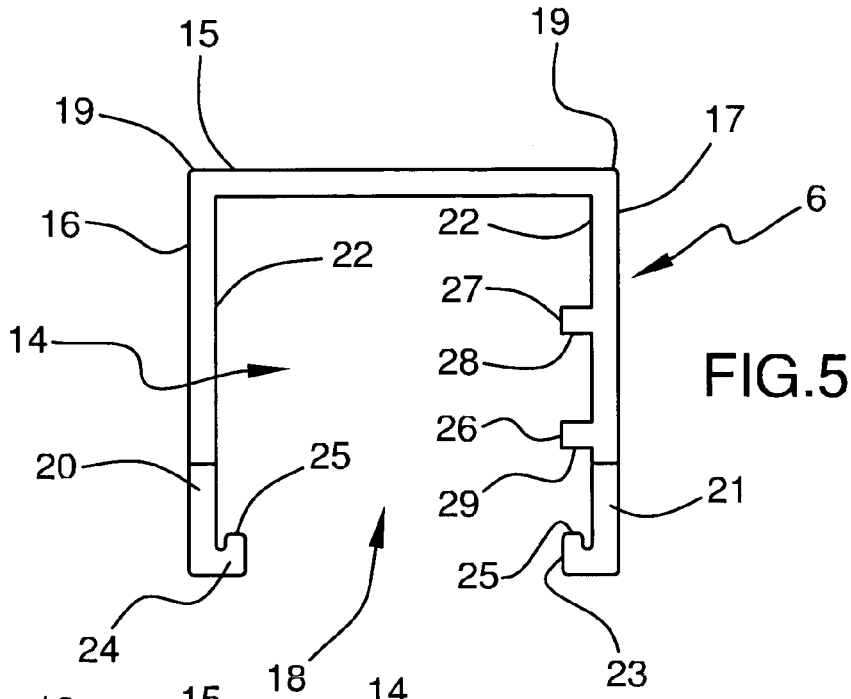
FIG. 5 is an end view of the rail of this invention.
Figure 6:
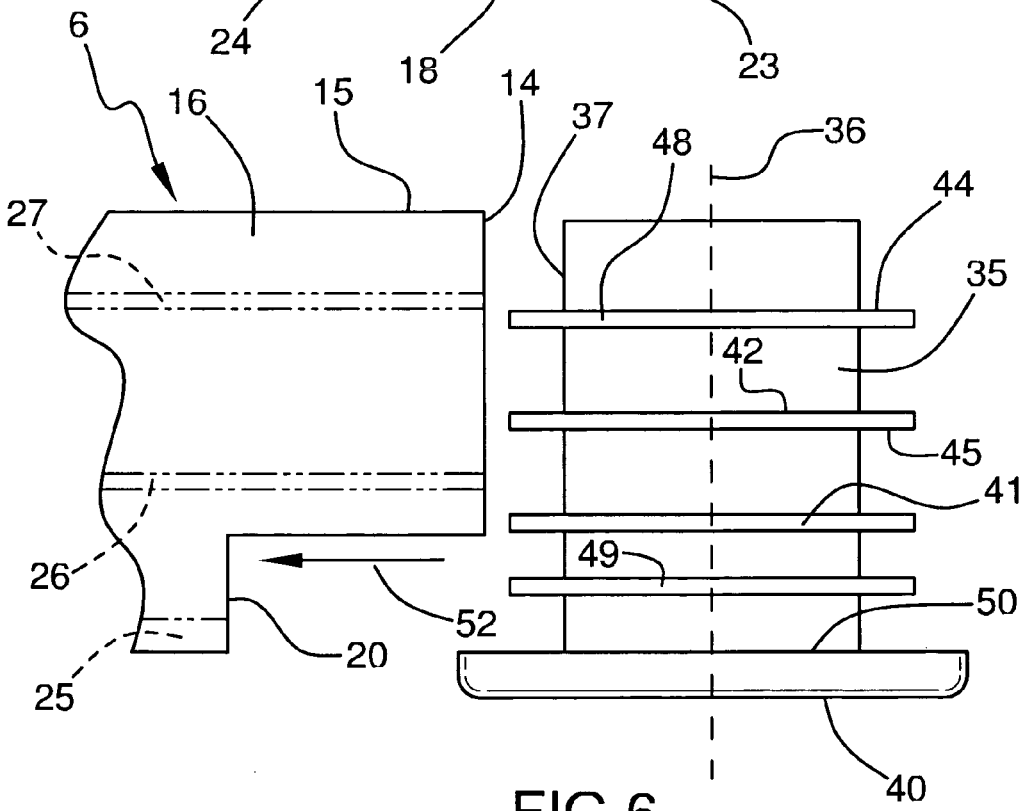
FIG. 6 a fragmentary, schematic side view of a plug and rail aligned in parallel planes in accord with this invention.

As shown in FIG. 6, when the axis 36 of plug 5 is oriented parallel to the sides 16 and 17 of rail 6 and perpendicularly to the rail side 15, the upper and lower flat surfaces 44 and 45 of the the segments 42 and the surface 50 of the cap 40 will be in planes that are parallel to the ribs 26 and 27 and the ledge surface 25 inside of rail 6. As shown in FIG. 5, the ribs 26 and 27 and ledges 23 and 24 are exposed through the open end 14 of the rail 6. Plug 5 should have a side 37 aligned with open end 14, and then the plug can be inserted onto the rail by moving it in a path 52 that is parallel to the parallel ribs 26 and 27 and ledges 25 and is perpendicular to its axis 36. The plug 5 should continue to be slid into rail 6 in the parallel path 52 until some of the shoulders 41 engage a rib 26 and ledge 25 with sufficient friction to hold the plug inside the rail. Sliding of the plug into the rail should continue and should be stopped when the side of the plug facing the open end 14 is substantially aligned with the inner edges of the notches 20 and 21. This ensures that the plug 5 will be sufficiently close to the post 7 in a position where it will block the insect entry path into the post after the rail 6 has been attached to the post.

The friction fit that holds the plug 5 in rail 6 may be attained by predetermining the distances separating a ledge surface 25 and one rib 26, and the distances separating, and the location of, the uppermost and lowermost shoulders 48 and 49 on the plug 5. The upper surface 25 of ledge 23 and the lower surface 28 of rib 27 are spaced apart inside of said rail by a first a predetermined distance 53. The predetermined distances separating the shoulders 41 on plug 5 are set so that the upper flat surface 44 of segments 42 of the uppermost shoulder 48 are spaced from the lower flat surface 45 of the corresponding segment 42 of the lowermost shoulder 49 by a predetermined second distance 54. When the plug 5 has been slid along the path 52 into the open end of rail 6, the upper flat surface 44 of one segment 42 of uppermost shoulder 48 engages the underside 28 of rib 27, and the lower flat surface 45 of another corresponding segment 42 on lowermost shoulder 49 engages the upper surface 25 of ledge 23. By making the predetermined distance 54 separating an upper surface 44 of one segment from the lower surface 45 of a corresponding segment slightly greater (e.g. 1 mm) than the predetermined distance 53 that separates the lower surface 28 of rib 27 from the upper surface 25 of ledge 23 results in the friction fit between plug 5 and rail 6 that securely holds the plug inside of said rail.

After a plug 5 has been used inside of a rail 6, if removal of the plug reveals that the segments 42 that were frictionally engaged between the ledge 23 an rib 27 have been bent out of shape or otherwise damaged, the plug 5 can be rotated ninety degrees and a different pair of segments 42 can be slid into frictional engagement with the rib and ledge, thus extending the useful life of the plug. The friction fit between plug and rail is strong enough to hold the plug in its insect blocking position during prolonged exposure to the outdoor weather conditions the plug encounters in the open side 18 of rail 6.

While the present invention has been described with reference to particular embodiments and methods, it is not intended to illustrate or describe all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

I claim:

1. A fence comprising:

a hollow post having a flat side, a generally rectangular hole in said flat side for insertion of a rail into said post;

a hollow, generally rectangular rail having an open terminal end, said rail having three continuous elongated flat sides, one of said flat sides being horizontal, the remaining two flat sides being vertical and parallel to each other, said rail having another side that defines a channel opening running the entire length of said rail, said flat sides being joined to each other at right angles so that said rail has the configuration of a three sided square with one open side that faces downwardly, each of said flat sides having an inside surface that is exposed to the atmosphere through said open side, one of the flat vertical sides having a ledge at its lower end that projects from its inside surface into said open side toward the other vertical side, said ledge having an upper surface, said one flat vertical side having a rib on its inside surface that extends toward said other vertical side, said rib having a lower surface, said upper surface of said ledge and said lower surface of said rib being parallel and spaced apart inside of said rail;

said open terminal end of said rail being inserted into said hole in said post with said open side of said rail facing downwardly, said open side of said rail and said open terminal end of said rail providing a continuous atmospheric pathway to said post through said hole; and an integral resilient plug for substantially blocking said atmospheric pathway between said hole in said post and said open side of said rail, comprising: a main body portion having four sides of equal length and equal width and equal thickness, said sides being joined to each other at right angles, a plurality of shoulders of uniform thickness protruding from said main body portion, said shoulders being spaced from each other along a longitudinal axis of said main body portion, each of said shoulders having a segment that is integral with one of said four sides of said main body portion, each of said segments having a continuous upper flat surface and a continuous lower flat surface, said upper and lower flat surfaces of each segment extending perpendicularly from the sides of said main body portion in parallel planes that are perpendicular to said longitudinal axis, and an end cap having a flat inner surface integral with said main body portion that closes one end of said main body portion; and the upper flat surface of one of said segments engaging said rib inside of said rail and the lower flat surface of another of said segments engaging said ledge on the inside of said rail so as to cause a friction fit between said plug and said rail that holds said plug inside of said rail wherein said plug blocks the continuous atmospheric pathway to prevent flying insects from entering said post through said hole.

2. The fence defined in claim 1, wherein said upper surface of said ledge and said lower surface of said rib are spaced apart a predetermined distance inside of said rail, said shoulders of said plug are spaced from each at predetermined distances along the longitudinal axis of said main body portion, the predetermined distances separating said shoulders being set so that the upper flat surface of said one segment is spaced from the lower flat surface of said another segment by a distance that is slightly greater than said predetermined distance that separates said lower surface of said rib from said upper surface of said ledge, said upper flat surface of said one segment engaging said underside of said rib and said lower flat surface of said another segment engaging said upper surface of said ledge, so that said slightly greater predetermined distance separating said upper flat surface of said one segment from said lower flat surface of said another segment causes said friction fit between said plug and rail that holds said plug inside of said rail.

3. The fence defined in claim 1, wherein said shoulders are spaced from each other at substantially equal distances along said length of said main body portion.

4. The fence defined in claim 1, wherein said segments of said shoulders are joined to each other at a right angle at each of their ends so that each shoulder continuously circumscribes said main body portion.

5. The fence defined in claim 1, wherein said upper and lower flat surfaces of said segments have outer edges that terminate at the same distance from the sides of said main body portion.

6. The fence defined in claim 1, further comprising: said shoulders being spaced from each other at substantially equal distances along said length of said main body portion, said segments of said shoulders being joined to each other at a right angle at each of their ends so that each shoulder continuously circumscribes said main body portion, and said upper and lower flat surfaces of said segments have outer edges that terminate at the same distance from the sides of said main body portion.

7. The fence defined in claim 1, further comprising: said main body portion of said plug being hollow with one end closed by said end cap and an opposite end open to the atmosphere, said end cap having outer peripheral edges that extend past said main body portion beyond a distance that outer edges of said flat surfaces of said segments protrude beyond the sides of said main body portion, and said inner surface of said end cap is parallel to said parallel planes of said flat surfaces of said segments and perpendicular to said longitudinal axis of said plug.

8. The fence defined in claim 1, further comprising: said main body portion of said plug being hollow with one end closed by said end cap and an opposite end open to the atmosphere, said shoulders being spaced from each other at substantially equal distances along said longitudinal axis of said main body portion, said segments of said shoulders being joined to each other at a right angle at each of their ends so that each shoulder continuously circumscribes said main body portion, said upper and lower flat surfaces of said segments having outer edges that terminate at the same distance from the sides of said main body portion, said end cap having outer peripheral edges that extend past said main body portion beyond said distance that said outer edges of said flat surfaces of said segments terminate past the sides of said main body portion, and said inner surface of said end cap being parallel to said parallel planes of said flat surfaces of said segments.

9. The fence defined in claim 1, further comprising: the flat vertical sides of said rail each having a locator notch at the open terminal end of the rail, said open terminal end being inserted into said hole in said post until said notches prevent further insertion by engagement with said post, said rail having openings in its horizontal flat side, fence pickets extending vertically through said openings in said rail beyond said rail, and means securing said fence pickets in said rail.

* * * * *